US009972153B2

(12) United States Patent
Frye et al.

(10) Patent No.: US 9,972,153 B2
(45) Date of Patent: May 15, 2018

(54) AUTHENTICATING A VEHICLE USER

(71) Applicant: General Motors LLC, Detroit, MI (US)

(72) Inventors: Mark S. Frye, Grosse Point Woods, MI (US); Paul H. Pebbles, Novi, MI (US); Dwight D. Brown, Bloomfield Hills, MI (US); Jessica M. Bala, Royal Oak, MI (US)

(73) Assignee: GENERAL MOTORS LLC, Detroit, MI (US)

( * ) Notice: Subject to any disclaimer, the term of this patent is extended or adjusted under 35 U.S.C. 154(b) by 8 days.

(21) Appl. No.: 14/969,788

(22) Filed: Dec. 15, 2015

(65) Prior Publication Data

US 2017/0169639 A1 Jun. 15, 2017

(51) Int. Cl.
*G07C 9/00* (2006.01)
*G07C 5/02* (2006.01)

(52) U.S. Cl.
CPC ..... *G07C 9/00158* (2013.01); *G07C 5/02* (2013.01)

(58) Field of Classification Search
CPC ..... G07C 9/00007; G07C 9/00103
USPC ..... 340/5.5
See application file for complete search history.

(56) References Cited

U.S. PATENT DOCUMENTS 6,225,890 B1 * 5/2001 Murphy ..... B60R 25/012 307/10.5
6,810,309 B2 10/2004 Sadler et al.
7,138,904 B1 11/2006 Dutu
7,431,120 B2 10/2008 Pollehn et al.
8,022,831 B1 * 9/2011 Wood-Eyre ..... B60T 7/14 180/272
8,818,614 B1 8/2014 Lekutai
8,937,528 B2 1/2015 Protopapas
2007/0124599 A1 5/2007 Morita et al.
2007/0239992 A1 * 10/2007 White ..... B60K 28/063 713/186

(Continued)

OTHER PUBLICATIONS

Liu, et al. "A Practical Guide to Biometric Security Technology" Security; 2001; pp. 27-32.

(Continued)

*Primary Examiner* — Vernal Brown
(74) *Attorney, Agent, or Firm* — Harness, Dickey & Pierce, P.L.C.

(57) ABSTRACT

A system includes a vehicle, a vehicle communications platform (VCP), and an in-vehicle biometric system. The VCP is programmed to recognize a sequence of events. The sequence of events includes a transmission of the vehicle shifting from drive to park, an engine of the vehicle is on, and the transmission of the vehicle shifting back from park to drive. The VCP is further programmed to, in response to the sequence of events, monitor a distance that the vehicle travels or monitor a time since an occurrence of the sequence of events, and to instruct the in-vehicle biometric system to enter an authentication mode after a set time has passed since the occurrence of the sequence of events or after the vehicle has traveled a set distance since the occurrence of the sequence of events. The in-vehicle biometric system is responsive to instructions from the VCP and initiates an authentication routine.

11 Claims, 1 Drawing Sheet

(56) References Cited

U.S. PATENT DOCUMENTS

| | | | | |
|---|---|---|---|---|
| 2008/0238690 | A1 | 10/2008 | Plant | |
| 2011/0074565 | A1* | 3/2011 | Cuddihy ..... | B60N 2/002<br>340/457 |

OTHER PUBLICATIONS

Srivastava, "A Comparison Based Study on Biometrics for Human Recognition"; IOSR-JCE; 2013; vol. 15, Issue 1; pp. 22-29.

* cited by examiner

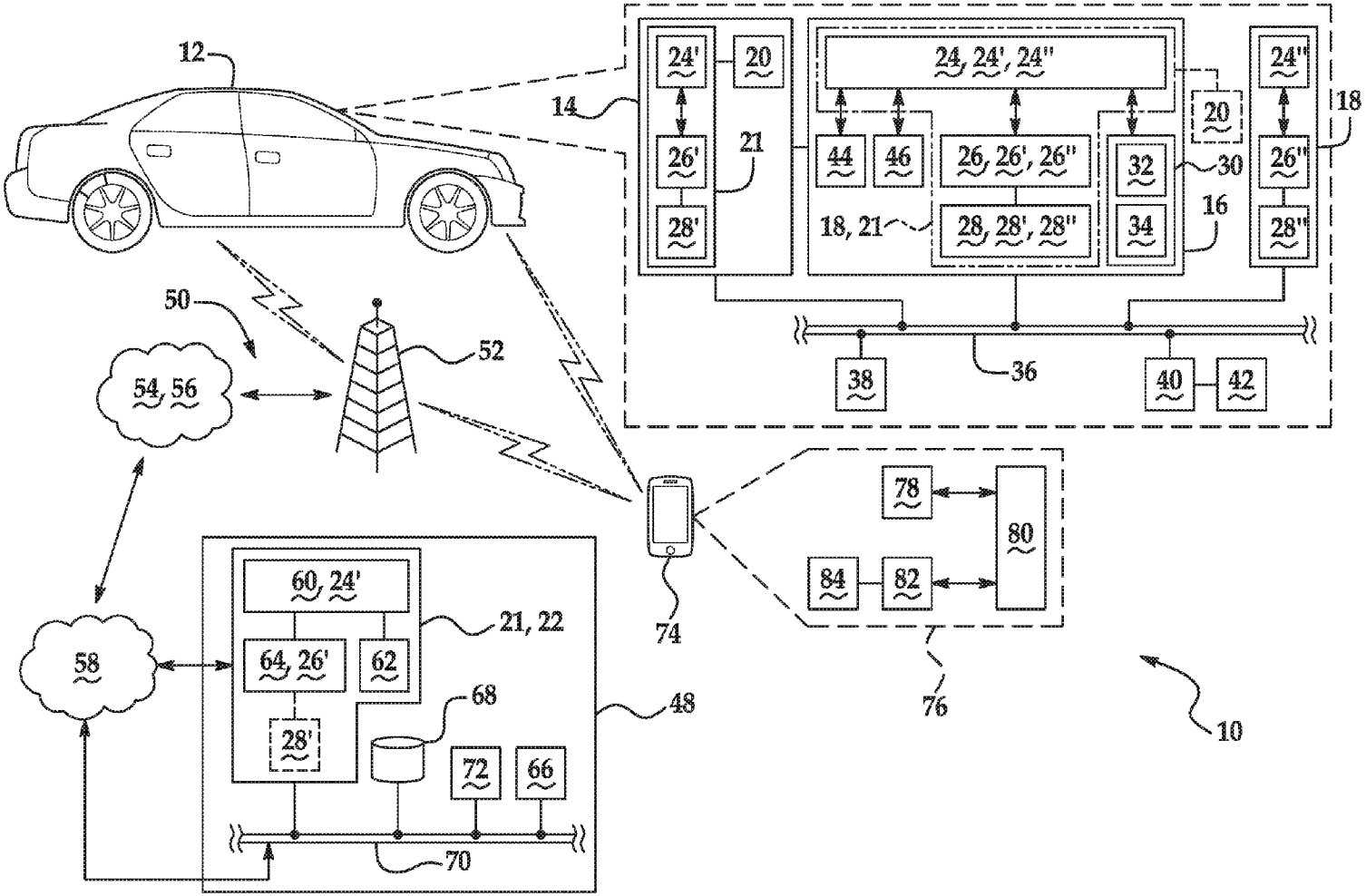
10
12
14
16
18
18, 21
20
21
21, 22
24, 24', 24''
24'
24''
26, 26', 26''
26'
26''
28, 28', 28''
28'
28''
30
32
34
36
38
40
42
44
46
48
50
52
54, 56
58
60, 24'
62
64, 26'
66
68
70
72
74
76
78
80
82
84

AUTHENTICATING A VEHICLE USER

TECHNICAL FIELD

The present disclosure relates generally to authenticating a vehicle user.

BACKGROUND

Many consumer electronic devices are equipped with biometric capabilities that allow the devices to identify the user. Biometrics are measurements based on distinctive human characteristics. Biometrics can be used to identify a potential user of a device and to grant or restrict access to the device based on the identity of the user.

SUMMARY

A system for authenticating a vehicle user is disclosed herein. An example of the system includes a vehicle, a vehicle communications platform, and an in-vehicle biometric system. The vehicle communications platform is programmed to recognize a sequence of events. The sequence of events includes a transmission of the vehicle shifting from drive to park, an engine of the vehicle is on, and the transmission of the vehicle shifting back from park to drive. The vehicle communications platform is further programmed to, in response to the sequence of events, monitor a distance that the vehicle travels after the occurrence of the sequence of events or monitor a time since an occurrence of the sequence of events, and to instruct the in-vehicle biometric system to enter an authentication mode after a set time has passed since the occurrence of the sequence of events or after the vehicle has traveled a set distance since the occurrence of the sequence of events. The in-vehicle biometric system is responsive to instructions from the vehicle communications platform and initiates an authentication routine.

Another example of the system for authenticating a vehicle user includes a vehicle, a vehicle communications platform, and an in-vehicle biometric system. The vehicle communications platform is programmed to monitor for an occurrence of a pre-set driving event during a vehicle trip and instruct an in-vehicle biometric system to reenter an authentication mode after recognizing that the pre-set driving event has occurred. The in-vehicle biometric system is programmed to initiate an authentication routine at a beginning of the vehicle trip, and to initiate a subsequent authentication routine in response to instructions from the vehicle communications platform indicating that the pre-set driving event has occurred.

Still another example of the system for authenticating a vehicle user includes a vehicle state switch responsive to a user input and an in-vehicle biometric system. The vehicle state switch identifies a predefined driving group to which the vehicle user belongs as either a small group or a large group. The in-vehicle biometric system includes an acquisition device and a microprocessor. The acquisition device collects a biometric sample from the vehicle user. When the vehicle state switch identifies the predefined driving group as a small group, the microprocessor runs a local biometric comparison routine on the biometric sample. When the vehicle state switch identifies the predefined driving group as a large group, the microprocessor transmits the biometric sample to an off-board server for authentication.

BRIEF DESCRIPTION OF THE DRAWING

Features of examples of the present disclosure will become apparent by reference to the following detailed description and drawing, in which like reference numerals correspond to similar, though perhaps not identical, components.

FIG. 1 is a schematic view of an example of a system for authenticating a vehicle user.

DETAILED DESCRIPTION

Examples of the system disclosed herein utilize biometric authentication technology. Biometric authentication technology refers to technology that can verify a user's identity based on distinctive human characteristics. As an example, the verification time of biometric authentication technology may be from about 1 second to about 3 seconds. Examples of biometric authentication technology include fingerprint recognition technology, palm print recognition technology, hand geometry recognition technology, retina recognition technology, iris recognition technology, facial mapping technology, signature recognition technology, voice recognition technology, vein recognition technology, DNA recognition technology, and ear geometry recognition technology.

In the examples disclosed herein, the vehicle includes an in-vehicle biometric system equipped with hardware that supports the biometric authentication technology. The in-vehicle biometric system is able to initiate and run an authentication routine. In some examples, the in-vehicle biometric system initiates and runs an authentication routine in response to instructions from the vehicle communications platform after a set time has passed since the occurrence of a sequence of events and/or after the vehicle has traveled a set distance since the occurrence of the sequence of events. The sequence of events includes a transmission of the vehicle shifting from drive to park, an engine of the vehicle is on, and the transmission of the vehicle shifting back from park to drive. In other examples, the in-vehicle biometric system initiates and runs an authentication routine at a beginning of the vehicle trip, and initiates a subsequent authentication routine in response to instructions from the vehicle communications platform indicating that a pre-set driving event has occurred. In still other examples, the in-vehicle biometric system initiates and runs an authentication routine when a vehicle state switch identifies a predefined driving group as a small group, and when the vehicle state switch identifies the predefined driving group as a large group, the in-vehicle biometric system transmits the biometric sample to an off-board server for authentication.

Referring now to FIG. 1, an example of a system 10 for authenticating a vehicle user is depicted. In one example, the system 10 includes the vehicle 12, the in-vehicle biometric system 14, and the vehicle communications platform (VCP) 16. In another example, the system 10 includes the vehicle 12, the in-vehicle biometric system 14, a vehicle state switch 18, and a server 22.

In the examples disclosed herein, the vehicle 12 may be a car, motorcycle, truck, or recreational vehicle (RV). The vehicle 12 is equipped with suitable hardware and computer readable instructions/code that allow it to communicate (e.g., transmit and/or receive voice and data communications) with the server 22.

At least some of the hardware and computer readable instructions/code are embodied in the VCP 16. In an example, the VCP 16 is an on-board vehicle dedicated communications and entertainment device. In another example (not shown), the VCP 16 is an on-board vehicle dedicated communications device (e.g., a telematics unit), and the vehicle 12 includes a separate on-board vehicle dedicated entertainment device (e.g., an infotainment unit). Whether integrated into a single unit (e.g., VCP 16) or included as separate units, the on-board vehicle dedicated communications and entertainment device(s) include hardware components that are capable of running computer readable instructions/code 28, which are embodied on non-transitory, tangible computer readable media.

The VCP 16 may provide a variety of services. One example of these services includes the VCP 16 recognizing a sequence of events, monitoring the distance that the vehicle 12 travels after occurrence of the sequence of events and/or the time since an occurrence of the sequence of events, and instructing the in-vehicle biometric system 14 to enter an authentication mode after a set time has passed since the occurrence of the sequence of events and/or after the vehicle 12 has traveled a set distance since the occurrence of the sequence of events. Another example of these services includes the VCP 16 monitoring for an occurrence of a pre-set driving event during a vehicle trip, and instructing the in-vehicle biometric system 14 to reenter an authentication mode after recognizing that the pre-set driving event has occurred. Several other examples of the services may include, but are not limited to: turn-by-turn directions and other navigation-related services provided in conjunction with a location detection unit; airbag deployment notification and other emergency or roadside assistance-related services provided in connection with various sensor interface modules 40 and sensors 42 located throughout the vehicle 12; and infotainment-related services where music, Web pages, movies, television programs, videogames and/or other content is downloaded by the VCP 16 via a vehicle bus system 36 and an audio bus system (not shown). The listed services are by no means an exhaustive list of all the capabilities of the VCP 16, but are simply an illustration of some of the services that the VCP 16 is capable of offering.

The VCP 16 may be used for vehicle communications. In some instances, vehicle communications are enabled through the VCP 16 via a communications module 30, which includes a cellular chipset/component 32 for voice communications and a data transmission system 34 for data transmission. The cellular chipset/component 32 of the VCP 16 may be an analog, digital, dual-mode, dual-band, multi-mode and/or multi-band wireless transceiver. The cellular chipset/component 32 uses one or more prescribed frequencies in standard analog and/or digital bands in the current market for cellular systems. Any suitable protocol may be used, including digital transmission technologies, such as TDMA (time division multiple access), CDMA (code division multiple access), W-CDMA (wideband CDMA), FDMA (frequency-division multiple access), OFDMA (orthogonal frequency-division multiple access), etc.

In an example, the data transmission system 34 may include a packet builder, which is programmed to make decisions about what packet to send (e.g., bandwidth, data to include, etc.) and to actually build a packet data message. In another example, the data transmission system 34 may include a wireless modem, which applies some type of encoding or modulation to convert the digital data so that it can communicate through a vocoder or speech codec incorporated in the cellular chipset/component 32. It is to be understood that any suitable encoding or modulation technique that provides an acceptable data rate and bit error may be used with the examples disclosed herein. While examples have been provided, it is to be understood that any suitable data transmission system 34 may be used.

The VCP 16 also includes an electronic processing device 24 operatively coupled to one or more types of electronic memory 26. In an example, the electronic processing device 24 is a microprocessor. In other examples, the electronic processing device 24 may be a micro controller, a controller, and/or a host processor. In another example, electronic processing device 24 may be an application specific integrated circuit (ASIC). The electronic memory 26 of the VCP 16 may be an encrypted memory that is configured to store i) computer readable instructions/code 28 to be executed by the processor 24, ii) data associated with the various systems of the vehicle 12 (i.e., vehicle data, VIN, etc.), iii) biometric sample templates, and/or the like. The electronic memory 26 may be a non-transitory, tangible computer readable media (e.g., RAM).

The VCP 16 is operatively connected to the vehicle bus system 36. The vehicle bus system 36 may utilize a variety of networking protocols, such as a controller area network (CAN), a media oriented system transfer (MOST), a local interconnection network (LIN), an Ethernet, TCP/IP, and other appropriate connections such as those that conform with known ISO, SAE, and IEEE standards and specifications, to name a few. The vehicle bus system 36 enables the vehicle 12 to send signals (e.g., real-time bus messages) from the VCP 16 to various units of equipment and systems (e.g., the in-vehicle biometric system 14). The vehicle bus system 36 also enables the vehicle 12 to receive signals at the VCP 16 from various units of equipment and systems (e.g., vehicle sensors 42). An example of a signal received by the VCP 16 through vehicle bus 36 includes data received by the vehicle sensors 42 indicating that the transmission (not shown) of vehicle 12 has shifted from drive into park or from park into drive. An example of a signal transmitted by the VCP 16 through the vehicle bus 36 includes an instruction to the in-vehicle biometric system 14 to initiate an authentication routine.

The VCP 16 (as shown in FIG. 1) may also include other components, such as, for example, a location detection unit 44 and a real-time clock 46.

The location detection unit 44 may include a GPS receiver, a radio triangulation system, a dead reckoning position system, and/or combinations thereof. In particular, a GPS receiver provides accurate time and latitude and longitude coordinates of the vehicle 12 responsive to a GPS broadcast signal received from a GPS satellite constellation (not shown). The location detection unit 44 may also include, for example, Glonass (i.e., global navigation satellite system), Sbas (i.e., satellite-based augmentation systems), or a D-GPS (differential global positioning system). The location detection chipset/component 44 may or may not be part of an in-vehicle navigation unit. In an example, the location detection unit 44 may provide location information for the VCP 16 to monitor the distance that the vehicle 12 has traveled after an occurrence of a sequence of events.

The real-time clock (RTC) 46 provides accurate date and time information to the VCP 16 hardware and software components that may require and/or request date and time information. In an example, the RTC 46 may provide time and/or date information for the VCP 16 to monitor the time since an occurrence of a sequence of events.

As illustrated in FIG. 1, the vehicle 12 may also include other vehicle systems that are directly or indirectly connected to the vehicle bus system 36. Example of these other vehicle systems may include sensor interface modules 40 and a user interface 38.

The vehicle sensors 42 may be operatively connected to and controlled by sensor interface modules 40, which are operatively connected to the vehicle bus system 36. The vehicle sensors 42 may be used to receive data about the state of the transmission (not shown) and engine (not shown) of the vehicle 12. The vehicle sensors 42 may also be used to receive data about the occurrence of a pre-set driving event.

The user interface 38 is operatively connected to the vehicle bus system 36. The user interface 38 allows a vehicle user to input information and commands to the vehicle 12 and receive information from the vehicle 12. The user interface 38 may be any command-driven user interface or any menu-driven interface. In an example, the user interface 38 is a graphical user interface (GUI). In another example, the user interface 38 is a human machine interface (HMI). The user interface 38 may include a display (not shown), a speaker (not shown), and/or a microphone (not shown). In an example, a vehicle user may use the user interface 38 to set a pre-set driving event. In another example, a vehicle user may use the user interface 38 to set the vehicle state switch 18 so that the vehicle state switch 18 identifies the predefined driving group as a small group or a large group.

The vehicle 12 also includes the in-vehicle biometric system 14. The in-vehicle biometric system 14 runs authentication routines to determine whether a vehicle user is an authorized user or an unauthorized user. The in-vehicle biometric system 14 includes an acquisition device 20 and a computing device 21. The acquisition device 20 collects a biometric sample from the vehicle user, and the computing device 21 determines whether the vehicle user is an authorized user or an unauthorized user. The acquisition device 20 is a separate from the VCP 16, but is in communication with the VCP 16. In one example, the computing device 21 is a standalone device in the vehicle 12 in communication with the VCP 16 (through the vehicle bus 36). In another example, the computing device 21 is integrated into the VCP 16 as software that is executed by the hardware (e.g., processor 24) of the VCP 16. In still another example the computing device 21 is hosted on the server 22. In still other examples, the computing device 21 may include two separate devices, one of which may be located on the vehicle 12 (either as a standalone device or resident within the VCP 16) and the other of which may be hosted on the server 22 so that the system 10 may run either a local comparison routine or a remote comparison routine on the biometric sample collected by the acquisition device 20.

It is to be understood that the type of acquisition device 20 used in the in-vehicle biometric system 14 may vary based on the type of biometric authentication technology used. In some examples, the acquisition device 20 may be a camera, a scanner, a signature pad, a microphone, a DNA sample extractor, or a combination thereof.

The computing device 21 includes an electronic processing device 24' operatively coupled to one or more types of electronic memory 26'. The electronic processing device 24' of the computing device 21 may be similar to the processor 24 of the VCP 16, and is capable of executing the computer readable instructions 28' stored in the memory 26', which may be similar to the electronic memory 26. In the examples disclosed herein, the computing device 21 is programmed to initiate and run authentication routines. To perform these operations, the computing device 21 executes computer readable instructions 28' that are stored on the memory 26'.

It is to be understood that before the in-vehicle biometric system 14 may authenticate a vehicle user, the vehicle user must enroll his or her biometric data. To begin enrollment, the acquisition device 20 collects a biometric sample from the vehicle user. The acquisition device 20 may collect the biometric sample in response to an instruction from the electronic processing device 24' of the computing device 21. Then the electronic processing device 24' generates a biometric template from the raw data in the biometric sample collected from the vehicle user. The biometric template is a mathematical representation of the biometric sample. The electronic processing device 24' generates the biometric template through the process of feature extraction. During the feature extraction process, the electronic processing device 24' applies a number of algorithms to the raw biometric data to locate and encode distinctive characteristics. Once the electronic processing device 24' generates the biometric template, the biometric template is stored on the electronic memory 26' and/or in a database 68. The biometric template created during the enrollment process is referred to herein as the stored template.

Once the in-vehicle biometric system 14 has created and saved the stored template for a vehicle user, the in-vehicle biometric system 14 may authenticate the vehicle user. To begin authentication, the acquisition device 20 collects a biometric sample from the vehicle user. The acquisition device 20 may collect the biometric sample in response to an instruction from the electronic processing device 24' of the computing device 21. The electronic processing device 24' generates a biometric template from the raw data in the biometric sample collected from the vehicle user through the feature extraction process. The biometric template created during the authentication process is the live template. Then the electronic processing device 24' compares the stored template to the live template using comparison algorithms. The electronic processing device 24' generates a score for the comparison, and based on that score the vehicle user is determined to be an authorized user or an unauthorized user. If the vehicle user is determined to an unauthorized user, the electronic processing device 24' may transmit (e.g., through the VCP 16 or the bus 70 of the center 48) a notification to a live advisor or a notification platform of the center 48. The live advisor or the notification platform (using additional logic) may than determine a message recipient(s) and send a message to the message recipient(s) indicating that an unauthorized person is operating the vehicle 12. If the vehicle user is determined to an authorized user, no notification is sent and the vehicle user is able to use the vehicle 12.

When the computing device 21 is located on the vehicle 12 either as a standalone device or resident within the VCP 16, the computing device 21 run a local comparison routine with the biometric sample collected by the acquisition device 20 and onboard templates to authenticate the vehicle user. When the computing device 21 is hosted on the server 22, the VCP 16 sends the raw data from the biometric sample to the server 22, and the server 22 acting as the computing device 21 will run a remote comparison routine with the biometric sample raw data and templates stored on the electronic memory 64 of the server 22 or in a database 68 to which the server 22 has access. As mentioned above, in some examples of the system 10, separate devices of the computing device 21 may be located on the vehicle 12 (either as a standalone device or resident within the VCP 16) and hosted on the server 22 so that the system 10 may run either a local comparison routine or a remote comparison routine on the biometric sample (e.g., in response to the vehicle state switch 18).

In the examples disclosed herein, the in-vehicle biometric system 14 may use any suitable biometric authentication technology or any suitable combination of biometric authentication technology. Examples of suitable biometric authentication technology include fingerprint recognition technology, palm print recognition technology, hand geometry recognition technology, retina recognition technology, iris recognition technology, facial mapping technology, signature recognition technology, voice recognition technology, vein recognition technology, DNA recognition technology, and ear geometry recognition technology.

The biometric authentication technology or combination of biometric authentication technologies may be selected for use in the in-vehicle biometric system 14 based on uniqueness (distinctiveness of the information content), permanence (sufficiently invariant over a certain period of time), universality (each individual should have the biometric feature), measurability (simplicity of extraction), comparability (simplicity of comparison between two templates as one is stored and the second one is a live template), collectability (how well can the identifiers be captured and quantified), invasiveness (the necessity of introducing an instrument into a body part), performance (accuracy, speed, security), circumvention (ability to fool the system), and/or user acceptance (extent to which society is supporting of the technology). For example, DNA recognition technology may have a high invasiveness as it may require a blood sample, but DNA has high permanence as it doesn't change throughout the life of the individual, and it has high universality as everyone has DNA. As another example, facial mapping technology has a low invasiveness as the in-vehicle biometric system 14 does not need to come in contact with the user, but it has medium permanence as a user's face changes with age.

The biometric authentication technology or combination of biometric authentication technologies may also be selected based on hygiene factors, ease of use, factors that may increase errors, verification time, and/or potential issues with integrating the biometric authentication technology into the automotive environment. Technology that requires user contact with the acquisition device 20 may negatively impact the hygiene of the in-vehicle biometric system 14. Factors that may increase errors include dirt, aging, injury, lighting, noise, and sickness. Potential issues with integrating the biometric authentication technology into the automotive environment may include space for the equipment needed to implement the technology and the use of gloves by vehicle users.

The biometric authentication technology or combination of biometric authentication technologies may also be selected based on the false acceptance rate (FAR), the false rejectance rate (FRR), the failure to enroll (FTE), and the sensor subject distance (SSD). The false acceptance rate is the rate at which the biometric authentication technology accepts an unauthorized user as an authorized person. In an example, the false acceptance rate of the authentication technology is greater than 0% to about 2%. The false rejectance rate is the rate at which the biometric authentication technology rejects an authorized person as an unauthorized person. In an example, the false rejectance rate of the authentication technology is greater than 0% to about 20%. The failure to enroll is the rate at which the biometric authentication technology is unsuccessful in its attempts to create a template from an input. The failure to enroll is typically defined by a minimum of three attempts. In an example, the failure to enroll of the authentication technology is greater than 0% to about 1%. The sensor subject distance is the distance between the human biometric part and the acquisition device 20. In an example, the sensor subject distance is from 0 cm to about 20 m.

In one example of the system 10, iris recognition technology is used. Iris recognition technology has a high uniqueness, permanence, universality, collectability, and performance; a medium measurability, comparability, invasiveness, and user acceptance; and a low circumvention. Iris recognition technology does not require contact with the acquisition device 20 and is not affected by dirt, aging, injury, noise, or sickness. The average verification time of iris recognition technology is about 2 seconds. In an example, the false acceptance rate of iris recognition technology is about 0.94%. In another example, the false rejectance rate of iris recognition technology is about 0.99%. In still another example, the failure to enroll of iris recognition technology is about 0.5%. In still another example, the sensor subject distance of iris recognition technology is about 30 cm. Iris recognition technology is commercially available from manufactures, such as HOYOS LABS® and EYELOCK®.

In one example of the system 10, facial mapping technology is used. Facial mapping technology has a high universality, collectability, user acceptance, and ease of use; a medium uniqueness, permanence, and measurability; and a low invasiveness. Facial mapping technology does not require contact with the acquisition device 20 and is not affected by dirt, noise, or sickness. The average verification time of facial mapping technology is about 3 seconds. In an example, the false acceptance rate of facial mapping technology is about 1%. In another example, the false rejectance rate of facial mapping technology is about 20%. In still another example, the sensor subject distance of facial mapping is about 20 m. Facial mapping technology is commercially available from manufactures, such as MRA DIGITAL® and INTEL®.

In some examples, the vehicle 12 also includes the vehicle state switch 18. The vehicle state switch 18 may be a combination of hardware and software in communication with the VCP 16 (through the vehicle bus 36) or may be integrated into the VCP 16 as software that is executed by the hardware (e.g., processor 24) of the VCP 16. Whether a standalone device or resident within the VCP 16, the vehicle state switch 18 improves the function of the in-vehicle biometric system 14 by identifying a predefined driving group to which the vehicle user belongs as either a small group or a large group. When the vehicle state switch 18 identifies the predefined driving group as a small group, the in-vehicle biometric system 14 (via electronic processing device 24') runs a local biometric comparison routine on the biometric sample. When the vehicle state switch 18 identifies the predefined driving group as a large group, the in-vehicle biometric system 14 (via VCP 16) transmits the biometric sample to the server 22 for authentication.

In an example the vehicle state switch 18 includes an electronic processing device 24" operatively coupled to one or more types of electronic memory 26". The electronic processing device 24" of the vehicle state switch 18 may be similar to the processor 24 of the VCP 16, and is capable of executing the computer readable instructions 28" stored in the memory 26", which may be similar to the electronic memory 26. In the examples disclosed herein, the vehicle state switch 18 is programmed to determine whether the predefined driving group to which the vehicle user belongs is a small group or a large group, and to instruct the VCP 16 accordingly. To perform these operations, the vehicle state switch 18 executes computer readable instructions 28" that are stored on the memory 26".

The memory 26" may also store predefined settings that define the small group. The vehicle user may define these settings by inputting which individuals are authorized members of the small group. When setting up the small group, the vehicle user may select members from the large group (e.g., whose existing authorized biometrics are stored off board the vehicle 12). The stored templates for the selected members may then be requested and/or received by the vehicle 12 from the server 22 and saved on the electronic memory 26'. Alternatively, the vehicle user may create the small group locally (i.e., in the vehicle 12). In this example, the vehicle user may be prompted to collect a biometric sample from each of the members that he/she wishes to include in the small group. These samples are stored templates for the members of the small group. Any individual outside of the small group may be considered to be a part of the large group, and stored templates for the members of the large group may be stored off board the vehicle 12.

It is to be understood that the vehicle state switch 18 is responsive to a user input. In some examples, the user input is entered by the vehicle user at the user interface 38. In other examples, the vehicle state switch 18 is a physical button in the vehicle 12. The user may push the button to set the vehicle state switch 18 to identify the predefined driving group as either the small group or the large group. In still other examples, the user input is entered at a remote computing device 74. The remote computing device 74 may then transmit the user input to the VCP 16. When identifying the predefined driving group, the user will select the group that the then-current driver is a part of. For example, if the then-current driver is the user's wife, and she is a member of the small group, the user may select the small group as the predefined driving group. For another example, if the then-current driver is a member of a car share program and thus a member of the large group, the user may select the large group as the predefined driving group.

The remote computing device 74 may be any computing device, including a smart phone, such as a GSM/LTE phone or a GSM/CDMA/LTE phone. In other examples, the remote computing device 74 may be any remote computing device that has a remote computing device communication platform 76. Examples of other remote computing devices 74 include a wearable device (e.g., smart bracelet, smart watch, helmet, etc.), a tablet computer, etc., each of which may be, for example, GPS, cellular/Internet wireless communication enabled, and short-range wireless communication enabled.

The remote computing device 74 may include a communications module 78, physical hardware (e.g., a microprocessor 80), and computer readable instructions 84 stored in an electronic memory 82 to enable it to transmit the user input to the VCP 16. The microprocessor 80 of the remote computing device 74 may be similar to the processor 24 of the vehicle 12, and is capable of executing the computer readable instructions 84 stored in the memory 82, which may be similar to the electronic memory 26.

As shown in FIG. 1, some examples of the system 10 include a server 22 which may be part of a center 48 that provides back-end services to the vehicle 12. In some of the examples disclosed herein, phone calls and/or data (e.g., biometric sample data, etc.) may be transmitted to, from, and/or between communication component(s) of the vehicle 12 and the server 22 using the carrier/communication system 50. Some of these communication links between the various components are shown as lightning bolts and arrows in FIG. 1.

In an example, the carrier/communication system 50 is a two-way radio frequency (RF) communication system. The carrier/communication system 50 may include one or more cell towers 52 or satellites (not shown). It is to be understood that the carrier/communication system 50 may also include one or more base stations and/or mobile switching centers (MSCs) 54 (e.g., for a 2G/3G network), one or more evolved Node Bs (eNodeB) and evolved packet cores (EPC) 56 (for a 4G (long-term evolution, LTE) network), and/or one or more land networks 58. The carrier/communication system 50 may be part of a cellular radio environment or a satellite radio environment, which may include a variety of wireless network providers (which include mobile network operator(s), not shown), utilizing the same or a variety of radio access technologies. While several examples have been provided, it is to be understood that the architecture of the wireless carrier/communication system 50 may be GSM (global system for mobile telecommunications), CDMA2000, UMTS (universal mobile telecommunications system), LTE, or some other available architecture.

An Internet connection may also be utilized for the transmission of message(s), biometric sample data, etc. In this example, the transmission of the message(s), biometric sample data, etc. may be made using the carrier/communication system 50, through the vehicle's Internet connection (e.g., when the vehicle 12 is equipped with a 4G long-term evolution, LTE, or other suitable Internet connection), through the Internet connection of a mobile communications device (e.g. when the mobile communications device is equipped with 4G long-term evolution, LTE, or other suitable Internet connection and is capable of acting as a secure hotspot), or through any other suitable Internet connection (e.g. when the vehicle 12 can securely connect to a hotspot).

The vehicle 12 is equipped with suitable hardware and computer readable instructions/code 28 that allow the vehicle 12 to communicate (e.g., transmit and/or receive voice and data communications) over the carrier/communication system 50. Using the communications module 30, the vehicle 12 is capable of making cellular or satellite connections and/or Internet connections (over the wireless carrier/communication system 50).

The vehicle 12 may use the VCP 16 for vehicle communications over the carrier/communication system 50. The vehicle communications utilize radio or satellite transmissions to establish a voice channel with the carrier/communication system 50 such that both voice and data transmissions may be sent and received over the voice channel. In some instances, vehicle communications are enabled through the VCP 16 via the communications module 30.

The vehicle 12 may be in communication with the server 22, which is part of the center 48. As an example, the vehicle 12 may transmit biometric sample data (as received by the acquisition device 20) to the server 22 as a data message using the data transmission system 34 and the wireless carrier/communication system 50. As another example, the vehicle 12 may communicate with the server 22 in order to receive data indicating whether the user is an authorized user or an unauthorized user.

It is to be understood that the center 48 shown in FIG. 1 may be virtualized and configured in a Cloud Computer, that is, in an Internet-based computing environment. For example, the server 22 (and other computing equipment) may be accessed as a Cloud platform service, or PaaS (Platform as a Service), utilizing Cloud infrastructure rather than hosting server 22 at the center 48. In these instances, the server 22 (and other center 48 components) may be virtualized as a Cloud resource. The Cloud infrastructure, known as IaaS (Infrastructure as a Service), typically utilizes a platform virtualization environment as a service, which may include components such as processor(s) 60, 66, server 22, and other computer equipment. In an example, the real-time services performed by the server 22 disclosed herein may be performed in the Cloud via the SaaS (Software as a Service).

The server 22 may be a system of computer hardware and computer readable instructions that is capable of supplying the vehicle 12 with data, which the VCP 16 of the vehicle 12 may use to determine if the vehicle user is an authorized user or an unauthorized user.

As shown in FIG. 1, the server 22 includes the processor 60, and the center 48 may also include additional processor(s) 66. The processors 60, 66 may be a controller, a host processor, an ASIC, or a processor working in conjunction with a central processing unit (CPU). The processor 60 is capable of executing the computer readable instructions that are stored on the electronic memory 64.

The server 22 also includes a server communication transceiver 62 that may be in selective communication with the VCP 16. The server communication transceiver 62 may be any suitable data transmission system that is capable of sending and/or receiving data communications over the carrier/communication system 50. For example, the server communication transceiver 62 is capable of receiving the biometric sample data from the VCP 16 of the vehicle 12. The server communication transceiver 62 can also transmit data indicating whether the user is an authorized user or an unauthorized user to the vehicle 12.

The database(s) 68 may be designed to store vehicle record(s), subscriber/user profile records, or any other pertinent subscriber and/or vehicle information. In an example, the database(s) 68 may be configured to store the user profile, which may contain personal information of the subscriber (e.g., the subscriber's name, stored biometric template, a billing address, a home phone number, a cellular phone number, etc.) and/or information of the vehicle 12 (e.g., identification number, etc.). It is to be understood that the databases 68 may allow the center 48 to function as a repository for data collected from the vehicle 12. In some instances, another facility may function as a repository for the collected data (e.g., a customer relationship management system (not shown) associated with the center 48 whose database(s) 68 the server 22 can access).

As illustrated in FIG. 1, the various center components may be coupled to one another via a network connection or bus 70 such as one similar to the vehicle bus 36 previously described.

In addition to the server 22, the center 48 may also include other components, such as additional processor(s) 66 and/or switch(es) 72. In some instance, the center 48 may also include advisor(s) (not shown). The additional processor(s) 66, which may be used in conjunction with telecommunication and computer equipment (not shown), may generally be equipped with suitable software and/or programs enabling the processor(s) 66 to accomplish a variety of center functions or tasks. The telecommunication and computer equipment (including computers) may include a network of servers (including server 22) coupled to both locally stored and remote databases (e.g., database 68) of any information processed. The switch(es) 72 may be private branch exchange (PBX) switch(es). The switch 72 routes incoming signals so that voice transmissions are usually sent to either a live advisor or an automated response system, and data transmissions are passed on to a modem or other piece of equipment (e.g., a communications module) for demodulation and further signal processing. Biometric sample data from the vehicle 12 may be transmitted to the server 22.

In one example of the system 10, the VCP 16 is programmed to recognize a sequence of events. The sequence of events includes the transmission (not shown) of the vehicle 12 shifting from drive to park, the engine (not shown) of the vehicle 12 is on, and the transmission (not shown) of the vehicle 12 shifting back from park to drive. This sequence of events may occur, for example, when the vehicle 12 is being parked by a valet, when the user is sitting in a line (e.g., drive-through, toll-way, etc.), or the like. The VCP 16 may recognize the occurrence of the sequence of events because of signals received through the vehicle bus 36 from the sensor interface module(s) 40. The sensors interfaces module(s) 40 may send signals indicating that the sequence of events has occurred to the VCP 16 because of data received by the vehicle sensors 42 indicating that the sequence of events has occurred. For example, a powertrain module may recognize that the transmission has been switched from one gear to another, that the engine remains on, and that transmission has been switched back. In this example, the powertrain module recognizes that the sequence of events has occurred and transmits a signal to the VCP 16 that indicates that the sequence of events has occurred. This signal may include a time stamp for the sequence of events.

In this example, once the VCP 16 recognizes that the sequence of events has occurred, the VCP 16 is programmed to monitor the distance that the vehicle 12 travels after the occurrence of the sequence of events and/or to monitor the time since an occurrence of the sequence of events. The VCP 16 may monitor the distance that the vehicle 12 travels using the location detection unit 44, and the VCP 16 may monitor the time using the real-time clock 46. Once the VCP 16 has determined that a set time has passed and/or that the vehicle 12 has traveled a set distance, the VCP 16 instructs the in-vehicle biometric system 14 to enter an authentication mode. In one example, the set time ranges from about 5 minutes to about 5 hours. In another example, the set time is at least 10 minutes. In still another example the set distance ranges from about 0.1 miles to about 5 miles.

In this example, the in-vehicle biometric system 14 is responsive to instructions from the VCP 16 and initiates an authentication routine. When running the authentication routine, the in-vehicle biometric system 14 will prompt the then-current driver to input a biometric sample using the acquisition device 20, and the collected live template will be compared with stored templates in the memory 26' in order to authenticate the then-current driver. In this example, the stored templates are those previously defined as authorized vehicle operators. In one example, the authentication routine is a local comparison routine run with the computing device 21 of the in-vehicle biometric system 14 located on the vehicle 12. In another example, the authentication routine is a remote comparison routine with the computing device 21 of the in-vehicle biometric system 14 hosted on the server 22. With the remote authentication routine, the live template is transmitted to the server 22 for comparison and authentication.

When the then-current driver is authenticated, the user can continue to operate the vehicle 12. When the then-current driver is not authenticated, a message may be sent from the VCP 16 to the vehicle owner indicating that a non-authorized person is operating his/her vehicle.

The previously described example involving the recognition of the sequence of events may be useful, for example, when the vehicle driver is using a valet. If the valet takes the vehicle 12 out for a drive and the set time and/or set distance is surpassed, the authentication routine will initiate. Since the valet's biometrics are not likely part of the stored templates of authorized vehicle operators, a message will be sent to the vehicle owner (e.g., through his/her mobile device) indicating that a non-authorized person is operating his/her vehicle.

In another example of the system 10, the vehicle user may set a pre-set driving event. The pre-set driving event may be any event that may occur during a vehicle trip. For example, the pre-set driving event may be changing the radio station to a set station, entering a set location, or achieving a set speed. The pre-set driving event may be entered by the vehicle user at the user interface 38. The vehicle user may input multiple pre-set driving events, which may be stored in the memory 26.

The VCP 16 is programmed to monitor for an occurrence of the pre-set driving event(s) during the vehicle trip. The VCP 16 may recognize the occurrence of a pre-set driving event because of signals received through the vehicle bus 36 from the sensor interface module(s) 40. The sensor interface module(s) 40 may send signals indicating that the pre-set driving event has occurred to the VCP 16 because of data received by the vehicle sensors 42 indicating that the pre-set driving event has occurred. As examples, the infotainment module of the VCP 16 may recognize that a particular radio station has been selected, the location detection unit 44 may recognize that a particular geographic region has been entered, and a body control module connected to the speedometer may recognize that the set speed has been reached. Each of these modules/units may send a signal to the VCP 16 indicating the occurrence of the driving event.

In this example, once the VCP 16 has determined that a pre-set driving event has occurred, the VCP 16 instructs the in-vehicle biometric system 14 to reenter an authentication mode. The in-vehicle biometric system 14 is programmed to initiate an authentication routine at a beginning of the vehicle trip, and to initiate a subsequent authentication routine in response to instructions from the VCP 16 indicating that the pre-set driving event has occurred. When running the subsequent authentication routine, the in-vehicle biometric system 14 will prompt the then-current driver to input a biometric sample using the acquisition device 20, and the collected live template will be compared with stored templates in the memory 26' in order to authenticate the then-current driver. In this example, the stored templates are those previously defined as authorized vehicle operators. In one example, the authentication routine is a local comparison routine run with the computing device 21 of the in-vehicle biometric system 14 located on the vehicle 12. In another example, the authentication routine is a remote comparison routine with the computing device 21 of the in-vehicle biometric system 14 hosted on the server 22. With the remote authentication routine, the live template is transmitted to the server 22 for comparison and authentication.

By initiating the subsequent authentication routine, the VCP 16 can ensure that the initially authenticated driver (i.e., at the beginning of the trip) is still operating the vehicle 12. When the then-current driver is authenticated, the user can continue to operate the vehicle 12. When the then-current driver is either not authenticated or is recognized as being a different driver than the initially authenticated driver (i.e., at the beginning of the trip), a message may be sent from the VCP 16 to the vehicle owner (e.g., on his/her mobile device, indicating that a non-authorized or different person is operating his/her vehicle.

In still another example of the system 10, the vehicle user can set the vehicle state switch 18 to indicate a predefined driving group as either a small group or a large group. The predefined driving group is the group of people who are authorized to drive the vehicle 12 at a particular time. The user may set the vehicle state switch 18 to indicate that the predefined driving group is a small group when the user, his or her family member(s), friend(s), etc. who are identified as part of the small group will be driving the vehicle 12. The user may select the small group when he/she knows that the driver has his/her stored template as part of the small group. The user may set the vehicle state switch 18 to indicate that the predefined driving group is a large group when the person who will be driving the vehicle 12 is not a member of the small group, for example, when the vehicle 12 is to be used in car sharing (i.e., pre-approved members renting the vehicle 12 for small periods of time (e.g., by the hour)), when the vehicle 12 is part of a company fleet (i.e., the vehicle 12 is part of a group of vehicles owned by a company for use by its employees), or the like. The vehicle state switch 18 may be set by the user with the user interface 38, the remote computing device 74, or a physical button within the vehicle 12. As one example of a user's large group and small group, the large group may be all the authorized drivers participating in a company car program and the small group may be the family of the user that is assigned to a particular vehicle in the company car program. As another example of a user's large group and small group, the large group may be all the authorized drivers in a national dealer demo fleet and the small group may be the approved drivers at a specific dealership.

In this example, the vehicle state switch 18 is in communication with the computing device 21, part of which is located on the vehicle 12 (either as a standalone device or resident within the VCP 16) and part of which is hosted on the server 22, so that when the in-vehicle biometric system 14 initiates an authentication routine, the in-vehicle biometric system 14 is responsive to the vehicle state switch 18. The acquisition device 20 collects a biometric sample from the vehicle user. When the vehicle state switch 18 identifies the predefined driving group as a small group, the electronic processing device 24' of the computing device 21 runs a local biometric comparison routine on the biometric sample. The local biometric comparison routine compares the live template with the stored templates of the members of the small group, which are stored in the onboard memory 26' at the in-vehicle biometric system 14. When the vehicle state switch 18 identifies the predefined driving group as a large group, the electronic processing device 24' transmits the biometric sample to the server 22 for authentication. Then the processor 60 of the server 22 runs a remote biometric comparison routine on the biometric sample. The remote biometric comparison routine compares the live template with the stored templates of the members of the large group, which are stored in the off-board memory 26' at the server 22. Since the large group has more members, most or all of which are unaffiliated with the vehicle owner, a larger and richer set of stored templates can be stored for comparison by the off-board memory 26' at the server 22.

It is to be understood that the term "communication" as used herein is to be construed to include all forms of communication, including direct and indirect communication. Indirect communication may include communication between two components with additional component(s) located therebetween.

Further, the terms "connect/connected/connection" and/or the like are broadly defined herein to encompass a variety of divergent connected arrangements and assembly techniques. These arrangements and techniques include, but are not limited to (1) the direct communication between one component and another component with no intervening components therebetween; and (2) the communication of one component and another component with one or more components therebetween, provided that the one component being "connected to" the other component is somehow in operative communication with the other component (notwithstanding the presence of one or more additional components therebetween).

It is to be understood that the ranges provided herein include the stated range and any value or sub-range within the stated range. For example, a range from about 5 minutes to about 5 hours should be interpreted to include not only the explicitly recited limits of from about 5 minutes to about 5 hours, but also to include individual values, such as 25 minutes, 3.75 hours, 4 hours etc., and sub-ranges, such as from about 1.5 hours to about 4 hours, etc. Furthermore, when "about" is utilized to describe a value, this is meant to encompass minor variations (up to +/−10%) from the stated value.

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

In describing and claiming the examples disclosed herein, the singular forms "a", "an", and "the" include plural referents unless the context clearly dictates otherwise.

While several examples have been described in detail, it is to be understood that the disclosed examples may be modified. Therefore, the foregoing description is to be considered non-limiting.

The invention claimed is:

1. A system for authenticating a vehicle user of a vehicle, comprising:

an in-vehicle biometric system; and a vehicle communications platform programmed to:

recognize, while the vehicle is on, a sequence of events including a transmission of the vehicle has shifted from drive to park, an engine of the vehicle is on, and the transmission of the vehicle has been shifted back from park to drive;

in response to the sequence of events, monitor a time since an occurrence of the sequence of events; and in response to determining that the time since the occurrence of the sequence of events is at least a set time, instruct the in-vehicle biometric system to initiate an authentication routine, wherein the in-vehicle biometric system initiates the authentication routine in response to the instruction.

2. The system as defined in claim 1 wherein the in-vehicle biometric system includes:

an acquisition device to collect a sample from the vehicle user in response to the instruction from the vehicle communications platform; and a microprocessor running a local comparison routine programmed to compare the sample with onboard templates of a predefined group to authenticate the vehicle user.

3. The system as defined in claim 1 wherein the set time is between about 5 minutes and about 5 hours.

4. The system as defined in claim 1 wherein the vehicle communications platform is further programmed to:

monitor a distance that the vehicle has travelled since the occurrence of the sequence of events; and in response to determining that the distance that the vehicle has travelled since the occurrence of the sequence of events is at least a set distance, instruct the in-vehicle biometric system to initiate the authentication routine; and wherein the set distance is between about 0.1 miles and about 5 miles.

5. The system as defined in claim 1 wherein the set time is between about 5 minutes and about 5 hours.

6. The system as defined in claim 1 wherein the vehicle communications platform is further programmed to:

monitor a distance that the vehicle has travelled since the occurrence of the sequence of events; and in response to determining that the distance that the vehicle has travelled since the occurrence of the sequence of events is at least a set distance, instruct the in-vehicle biometric system to initiate the authentication routine, wherein the set distance is between about 0.1 miles and about 5 miles.

7. A system for authenticating a vehicle user, comprising:

a vehicle communications platform, programmed to:

monitor for an occurrence of a pre-set driving event during a vehicle trip; and in response to determining that the pre-set driving event has occurred, instruct an in-vehicle biometric system to initiate an authentication routine; and an in-vehicle biometric system, programmed to:

initiate the authentication routine at a beginning of the vehicle trip; and in response to the instruction to initiate the authentication routine made in response to the determination that the pre-set driving event has occurred, initiate a subsequent instance of the authentication routine, wherein the vehicle remains in an on state between the beginning of the vehicle trip and the determination that the pre-set driving event has occurred.

8. The system as defined in claim 7, further comprising a user interface to receive an input used to set the pre-set driving event.

9. The system as defined in claim 7 wherein the pre-set driving event comprises at least one of: changing a radio station to a set station, entering a set location, or achieving a set speed.

10. A system for authenticating a vehicle user of a vehicle, comprising:

an in-vehicle biometric system; and a vehicle communications platform configured to:

receive a plurality of signals indicative of a sequence of events from a plurality of vehicle sensors;

recognize, while the vehicle is on, an occurrence of the sequence of events including a transmission of the vehicle has shifted from drive to park, an engine of the vehicle is on, and the transmission of the vehicle has shifted back from park to drive;

in response to the occurrence of the sequence of events, monitor a time since an occurrence of the sequence of events; and in response to determining that the time since the occurrence of the sequence of events is at least a set time, instruct the in-vehicle biometric system to enter an authentication routine, wherein the in-vehicle biometric system initiates the authentication routine in response to the instruction, and wherein the vehicle communications platform is configured to send a message to a vehicle owner indicating a non-authorized person is operating the vehicle when, via the authentication routine, the in-vehicle biometric system determines that the vehicle user is not authorized to operate the vehicle.

11. The system as defined in claim 10 wherein the in-vehicle biometric system includes:

an acquisition device to collect a sample from the vehicle user in response to the instruction from the vehicle communications platform; and a microprocessor running a local comparison routine programmed to compare the sample with onboard templates of a predefined group to authenticate the vehicle user.

* * * * *